US005255454A

United States Patent [19]

Pounds

[11] Patent Number: 5,255,454

[45] Date of Patent: Oct. 26, 1993

[54] APPARATUS FOR PREPARING TRENCHES

[75] Inventor: Rice H. Pounds, Kenansville, Fla.

[73] Assignee: Pounds Motor Company, Winter Garden, Fla.

[21] Appl. No.: 905,741

[22] Filed: Jun. 29, 1992

[51] Int. Cl.[5] ..... E02F 5/08

[52] U.S. Cl. ..... 37/94; 37/91; 37/189

[58] Field of Search ..... 37/80 A, 80 R, 94, 91, 37/189, DIG. 16

[56] References Cited

U.S. PATENT DOCUMENTS

| | | | |
|---|---|---|---|
| 1,462,488 | 7/1923 | George . | |
| 1,846,902 | 2/1932 | Powell . | |
| 2,063,584 | 12/1936 | Collins . | |
| 2,777,272 | 1/1957 | Smith et al. . | |
| 2,875,838 | 3/1959 | McLarty . | |
| 2,937,463 | 5/1960 | Pougnet . | |
| 3,115,190 | 12/1963 | Listiak . | |
| 3,328,902 | 7/1967 | Hanson . | |
| 3,387,436 | 6/1968 | Kasper . | |
| 3,766,672 | 10/1973 | Hanson et al. . | |
| 3,815,266 | 6/1974 | Schmitz et al. | 37/80 A X |
| 3,916,606 | 11/1975 | Brudnak, Jr. et al. . | |
| 4,073,245 | 2/1978 | Anderson . | |
| 4,432,672 | 2/1984 | Brüderle et al. | 37/80 A X |
| 4,535,555 | 8/1985 | Petraud | 37/94 |
| 4,887,372 | 12/1989 | Block | 37/80 A X |

FOREIGN PATENT DOCUMENTS 602692 3/1960 Italy .

OTHER PUBLICATIONS

Pamphlet "DondiDitcher" Dondi, 41037 Mirandola-Italy.

Pamphlet "ExcaRotor #661" Cerimon, Inc. P.O. Box 3395, College Station, Fredericksburg, Va. 22402.

Pamphlet "ExcaRotor #4220C" Impex International, Inc. P.O. Box 3441, Spartanburg, S.C. 29304.

Pamphlet "ExcaRotor #7420S" Impex International, Inc. P.O. Box 3441, Spartanburg, S.C. 29304.

Pamphlet "Impex/Dondi Ditchers" Impex International, Inc. P.O. Box 3441, Spartanburg, S.C. 29304.

Pamphlet "2G" Maletti Macchine Agricole, 41100 Modena-via W. Tabacchi, 125.

Pamphlet "Vee Mower" Orange Service Company, P.O. Box 852 Clermont, Fla. 32711.

*Primary Examiner*—Dennis L. Taylor
*Assistant Examiner*—J. Russell McBee
*Attorney, Agent, or Firm*—James H. Beusse

[57] ABSTRACT

An apparatus for preparing and refurbishing trenches having two cutters supported on a frame. During operation of the apparatus, the cutters rotate about an axis to prepare the trench. The distance between the cutters as well as the angle of the cutters are adjustable to change the size and shape of the trench. A cover is placed over the cutters and has a remotely adjustable orientation which can be varied to select the direction of earth being projected over the side of the trench during operation. The cutters are preferably powered by dedicated motors, and include a multiplicity of blades mounted on dual levels to increase efficiency of cutting the trench.

9 Claims, 6 Drawing Sheets

APPARATUS FOR PREPARING TRENCHES

BACKGROUND OF THE INVENTION

This invention relates to devices for digging and cutting in the ground, and more particularly to a trailer assembly for preparing and refurbishing trenches that are used to improve irrigation in citrus groves and other agricultural landscapes.

Many different devices have been used to dig trenches for agriculture irrigation, examples of which are disclosed in U.S. Pat. Nos. 4,535,555 and 4,887,372. These devices include rotating cutting blades connected to a frame that is pulled behind a tractor. The cutting blade when pulled is rotated about an axis perpendicular to the wall of the trench to dig new trenches and repair existing trenches.

The trees and shrubs for citrus groves are typically located in rows. Trenches are then dug between the rows to provide proper drainage for the soil. However, in some groves trees are placed further apart than other groves. Thus the width of the trench must be changed to accommodate the tree placement. A drawback to the prior trenching devices is that they do not provide adjustments for changing the trench width.

In closely spaced groves, conventional trenching devices discharge debris and earth in large particles and in a random direction. Many of the prior trenching devices cannot redirect this discharge resulting in damage to the leaves on the trees.

SUMMARY OF THE INVENTION

It is an object of this invention to provide an improved apparatus for digging and repairing trenches.

It is another object of this invention to prepare trenches with a left and right rotating cutting blade with a position that can be remotely moved to change the width and volume of the trench.

It is a further object of this invention to place a remotely adjustable cover over the discharge of a trencher's cutting blade to redirect the discharge to prevent crop damage when preparing trenches.

An additional object of this invention is to dig trenches with a blade that breaks down the earth being dug into small particles to prevent large particle from damaging the foliage.

These and other objects are provided with an apparatus for preparing trenches comprising an elongated frame, a left and right support pivotally carried by the frame and a left and right rotatable cutter respectively connected to a left and right shaft. An axis of rotation extends through the shafts which is inclined with respect to horizontal. A left motor is connected to the left support and the left shaft. The left shaft extends from the left motor through the left support to connect to the left cutter. A right motor connected to the right support and the right shaft. The right shaft extends from the right motor through the left support to connect to the left cutter. The motors are operative to rotate the cutters about the axis. A device is connected between the support and the frame that pivots the support to change the angle of inclination of the cutter. Preferably, a device is connected between the support and the frame for remotely varying the distance between the left and right support to change the width of the trench.

In another aspect of the invention, an apparatus for preparing trenches in by removing earth in the ground is provided. The apparatus comprises an elongated frame, and a left and right support pivotally carried by the frame. A left and right rotatable cutter having a plurality of blades is used to cut the trenches. Each cutter has an axis of rotation which is inclined with respect to horizontal. The plurality of blades extend radially outward from the axis of rotation. At least one motor operative is connected to the other to rotate the blades about the axis to cut a trench out of the ground. A cover is pivotally connected to each support at a preselected orientation and radially aligned with the blades. The cover's orientation is selected to direct the angle of earth being projected over the side of the trench when the cutter rotates to prepare the trench. A hydraulic cylinder in combination with a controller is included for remotely varying the orientation of the cover on the support to change the angle the earth being projected.

BRIEF DESCRIPTION OF THE DRAWINGS

Further features and advantages of the invention will be apparent from the following description which is given solely by way of example with reference to the accompanying drawings, in which:

FIG. 9 is a simplified schematic diagram of a device for controlling the apparatus for preparing trenches.

DESCRIPTION OF THE PREFERRED EMBODIMENTS

Figure 1:
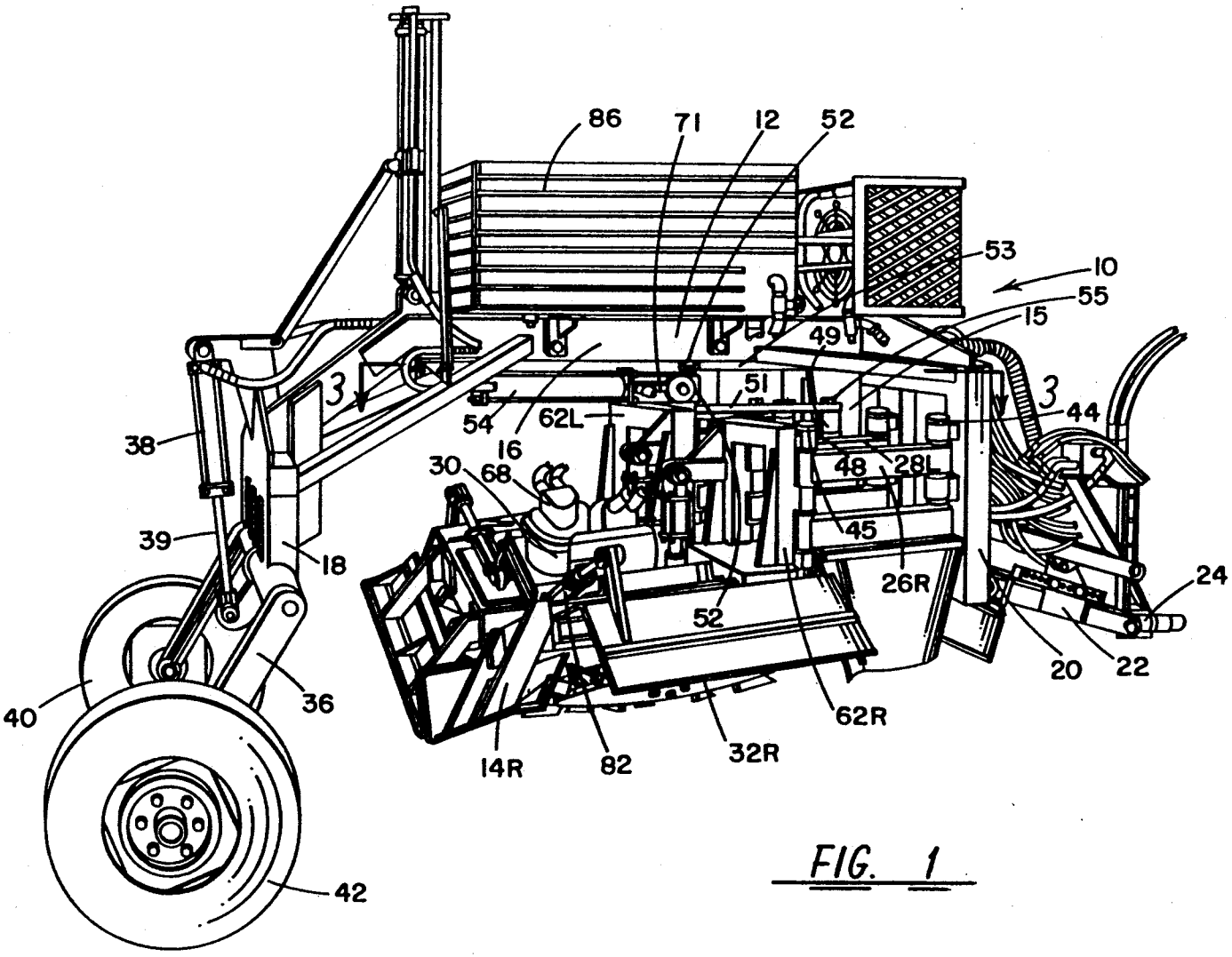
FIG. 1 is a right side perspective view of the apparatus for preparing trenches according to the invention.
Figure 2:
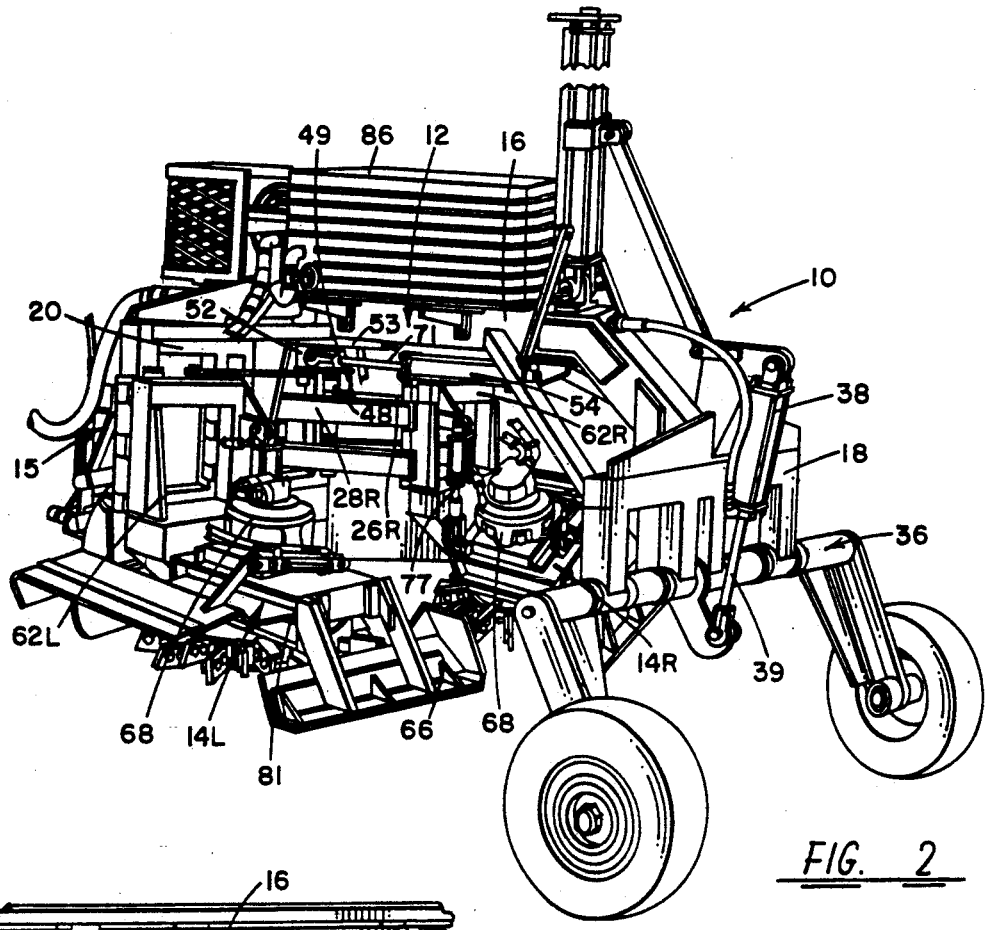
FIG. 2 is a front side perspective view of the apparatus shown in FIG. 1 with the cutter supports in a separated position.

Referring to FIGS. 1 and 2, there is shown the apparatus for preparing trenches generally referred to as trencher 10, having a frame 12 connected to support 14 (L and R) on a respective left and right side of trencher 10. Frame 12 includes a longitudinal bar 16 integrally connected at its rearward end to vertical rear frame 18 and connected at its forward end to vertical fame 20.

Figure 6:
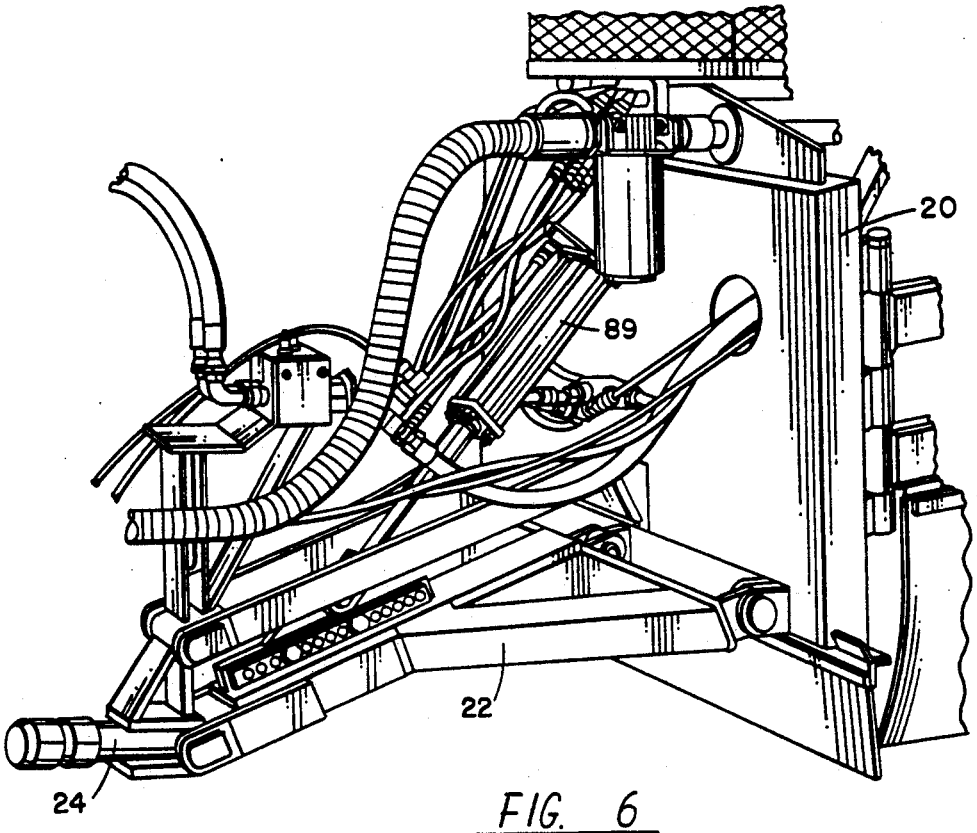
FIG. 6 is a front side perspective view of the apparatus shown in FIG. 1.

Referring to FIG. 1 and 6 vertical frame 20 is pivotally attached at its lower end tow bar 22 which is connected with pin 24 to a tow arm of a tractor. Referring to FIGS. 1–4, vertical frame 20 of trencher 10 is connected through a link assembly 15 which includes brs 26 (R and L) rectangular branch 62 (R and L), and bars 28 (R and L) to support 14 (R and L). Frame 20 is connected through bars 26R, branch 62R and bar 28R. Supports 14 (L and R) are disposed symmetrically on the left and right sides of trencher 10 and hold motor 30 (R and L) and cutter 32 (R and L) respectively.

Figure 5:
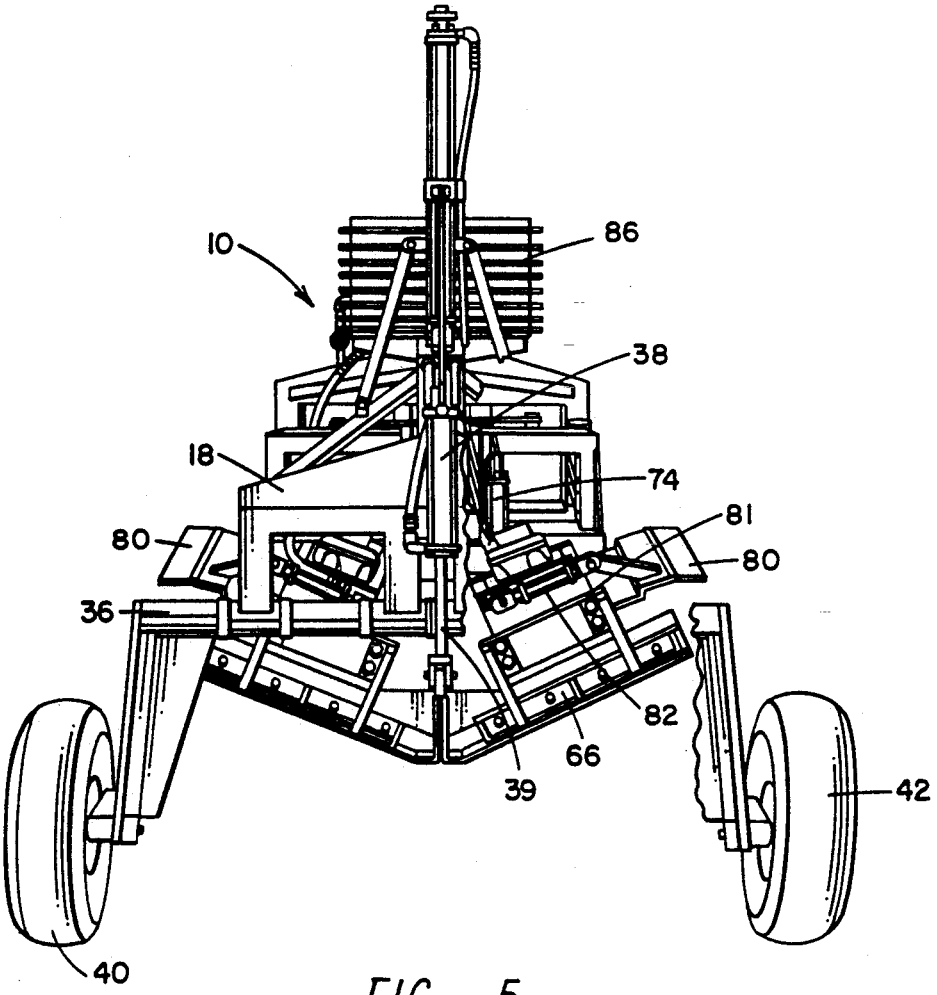
FIG. 5 is a rear partially sectioned view of the apparatus shown in FIG. 1.

Referring to FIGS. 1, 2 and 5, disposed at the rear end of trencher 10 and pivotally interlocked with the lower portion of frame 18 is fork 36. Hydraulic jack 38 is connected at one end to bar 18 and at its other end to fork 36. Jack 38 expands and contracts piston 39 to pivot fork on frame 18 to raise and lower supports 14 and cutter 32 into the ground during operation. Disposed at opposite ends of fork 36 are wheels 40 and 42 which are laterally spaced in a line longitudinally with tractor wheels (not shown). Conventionally, trencher 10 is pulled by a tractor to prepare, refurbish or excavate a trench. However, the invention is not limited to being pulled and trencher 10 may be adapted to be pushed in a forward direction as well.

The left side of link assembly 15 and frame 20 are identical and are symmetrical about the longitudinal axis of tractor 10. Thus only the right side will hereafter be described.

Referring to FIGS. 1–4, bars 26 are connected at one end with pin 44 to vertical frame 20. Bars 26 are pivotally connected at their other end to the outer portion of branch 62 with pin 45. An inner portion of branch 62 pivotally engages with wing bars 28 using pin 47. Bars 28 are pivotally connected at one end with pivot 45 to vertical frame 20. Attached to the mid-portion of the upper surface of the top parallel bar 28 is bar 48 which extends laterally outward from bar 26. A cylindrical coupling 49 integrally connects at its lower end to bar 48 and extends vertically upward therefrom. Horizontal strut 51 is attached at one end with pin 55 to coupling 49 and is attached at its other end with pin 52 to piston 65 of jack 54. Center pin 52 has a collar 55 that slides laterally along track 53 attached to a bottom surface of bar 16.

Figure 3:
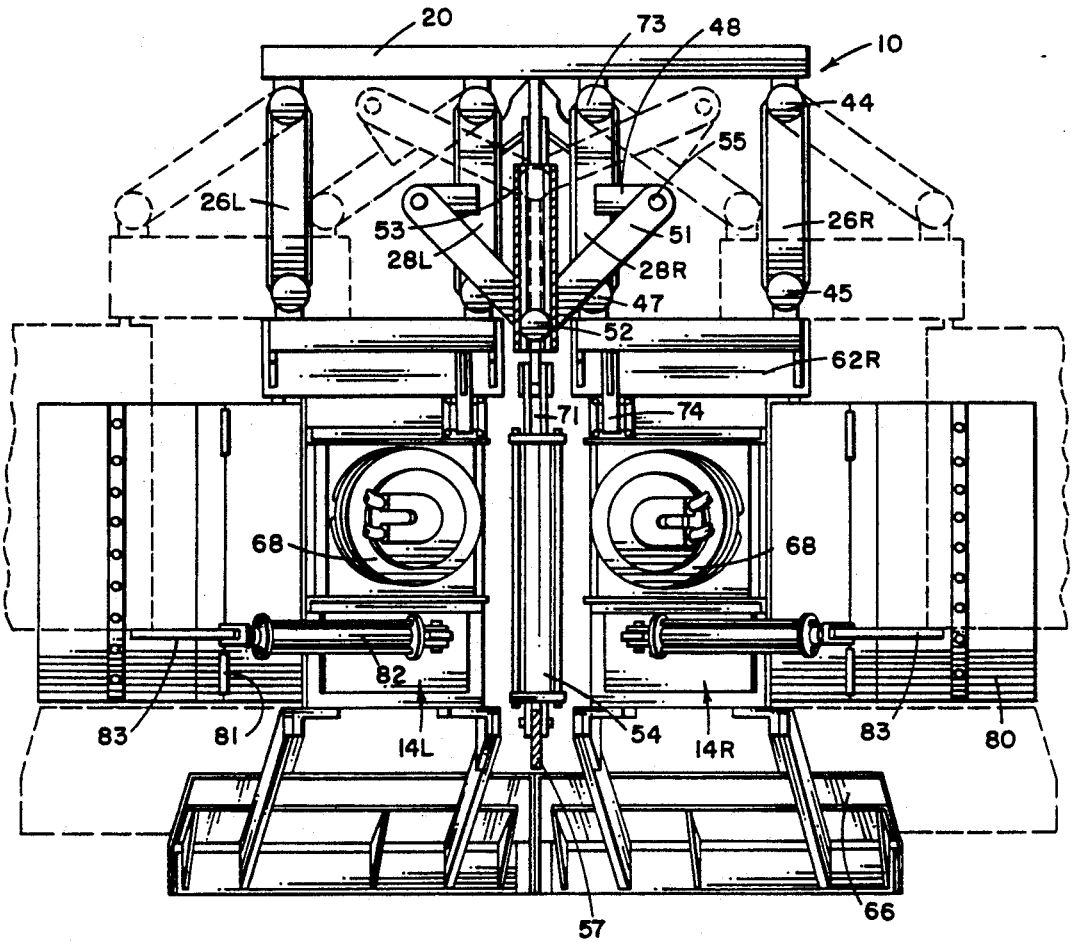
FIG. 3 is a partially sectioned top view of the apparatus along 3—3 of FIG. 1.

The rearward end of jack 54 is connected to the rear portion of bar 16 with coupling 57. Jack 54 is fed hydraulic fluid from control panel 110 (FIG. 9) which by conventional mean expands piston 71 outward to push pin 52 forward thereby forcing bars 28 (L and R) to pivot outward. In FIG. 3 there is shown in phantom the position of assembly 15 when piston 71 expands to its extended position.

Figure 4:
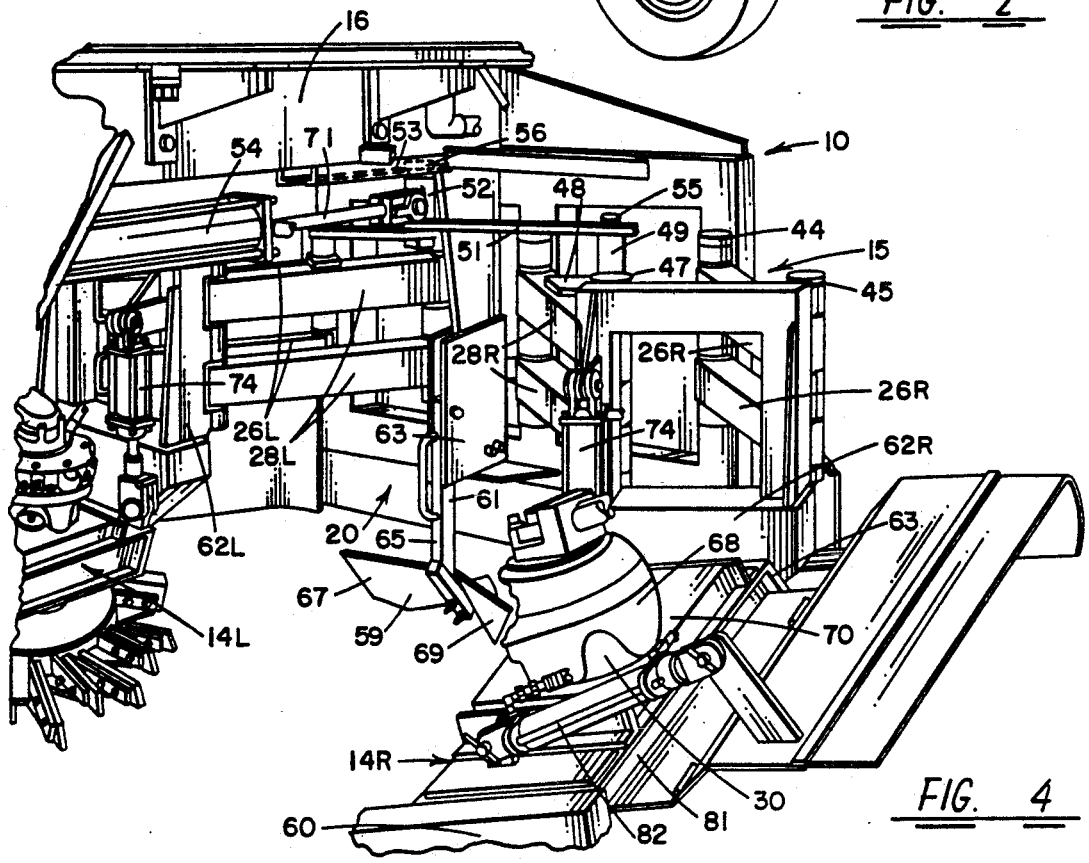
FIG. 4 is a partially cutaway perspective view of the apparatus illustrating the movement of the supports.

Referring to FIG. 4, there is shown a blade 59 which is optionally attached with adjustable bracket 61, that changes the height of blade 59, to a plate 63, engaging the mid-portion of frame 20. Blade 59 extends with bar 65 below frame 20 and has flat left and right blades 67 and 69 which plows through the center of a trench being refurbished when blade 59 is used.

Support 14 is pivotally attached along its side to branch 62 with pin 63 extending through support 14. Vertically oriented jack 74 is connected at its top end to branch 62 and connected at its bottom end to a top surface of frame 70 of support 14. Jack 74 includes a piston 77 which expands and contracts to vary the angle of support 14 and cutter 32 with respect to horizontal. Support 14 includes a rearward deflection portion 66 which has a vertical plated to prevent cutter 32 discharging debris behind trencher 10.

Support 14R and cutter 32R are placed on the right side of trencher 10, and cutter 32L and support 14R are positioned symmetrical about an axis of symmetry of trencher 10. Support 14 holds a motor 30 in housing 68.

Figure 8:
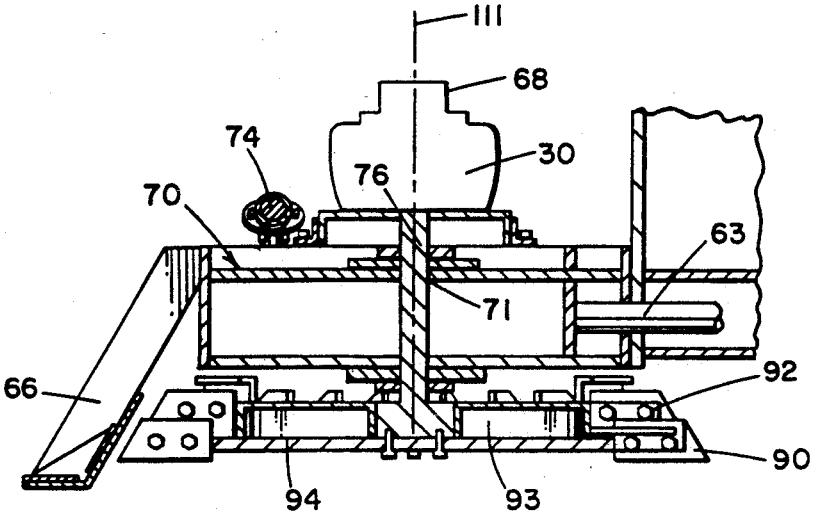
Figure 7:
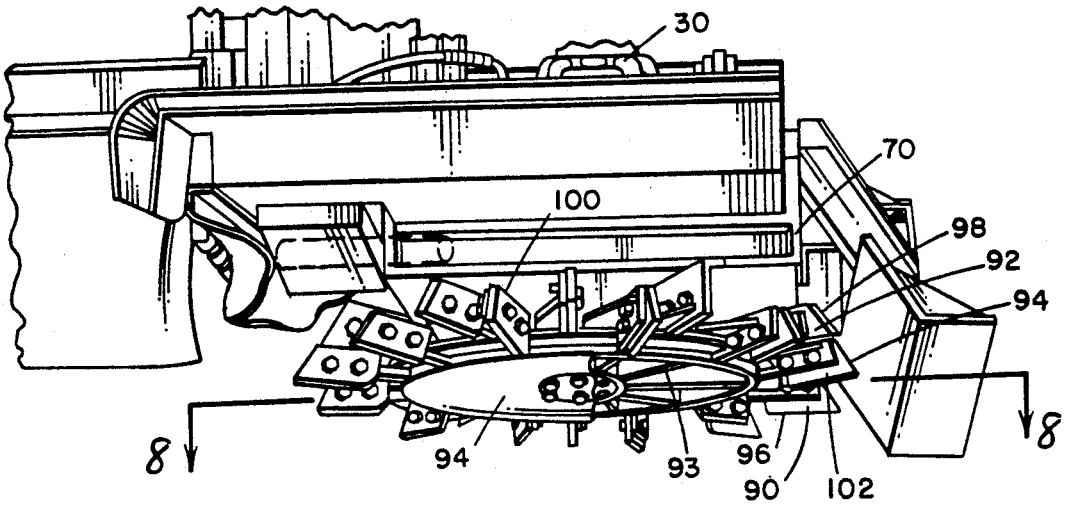
FIG. 7 is a bottom right side partially sectioned view shown in FIG. 1 illustrating the cutter blades and support.

Referring to FIGS. 7 and 8, a shaft 76 extends downward from motor 30 and is attached on the bottom side of frame 70 to blades 90 and 92. Referring to FIGS. 2–8, shield 80 is pivotally connected to lateral edge of frame 70 with elongated pin 81. The angle of shield 80 is controlled by expanding and contracting piston 83 of jack 82. It is recognized by changing the angle of shield 80 with respect to top surface of plate 70, the angle at which earth is projected out of trencher 10 during operation, is directed and controlled.

Hydraulic motor 30 is constructed using conventional techniques and is powered with fluid originating from hydraulic supply 86. Referring to FIGS. 7 and 8, motor 30 rotates elongated shaft 76 about a longitudinal axis 111. Shaft 76 extends through an aperture 71 in support 14. Each left and right hydraulic motor 30 independently controls the rotation of it3 s own respective blades 90 (L and R) and 92 (L and R) to increase precision during the trenching operation.

Referring to FIG. 6, disposed behind vertical frame 20 is a tow bar 22 pivotally connected to vertical frame 20. A jack 89 is oriented at an approximately 45° angle between vertical frame 20 and tow bar 22. Jack 89 is connected to the mid-portion of support 20 above tow bar 22, and extends to the mid-portion at tow bar 22. Piston 91 extends inward and outward from jack 89 to pivot tow bar 22 about frame 20. Pivoting tow bar 22 frame 20, raises and lowers frame 20 to change the angle of attack of cutters 32.

Referring to FIGS. 7 and 8, cutter 32 is shown having a first level of blades 90 and a second level of blades 92. Blades 90 and 92 rotate about axis 111 to excavate the ground and refurbish trenches. It has bee recognized by the inventor that when more than four blades are used and preferably at least 20 blades are used, smaller particles are dispersed when trench is refurbished thereby reducing damage to foliage. These blades 90 and 92 extend radially outward with struts 93 from shaft 76. Disposed at the end of shaft 76 is annular disk 94 which rotates in a horizontal plane normal to axis 111 of shaft 76.

Each of blades 90 and 92 have a flat lower surface 96 and 98 respectively. Further the front surface 104 and 108 is also flat. Disk 94 also has a flat front surface 102 in the vertical plane. Preferably the lower surface 98 are at a lower level than the upper surface 100. Blades 90 and 92 alternate between the first level and the second level while extending outward from shaft 76. Extending through shaft 76 is an axis 111 by which blades 90 and 92 rotates.

Figure 9:
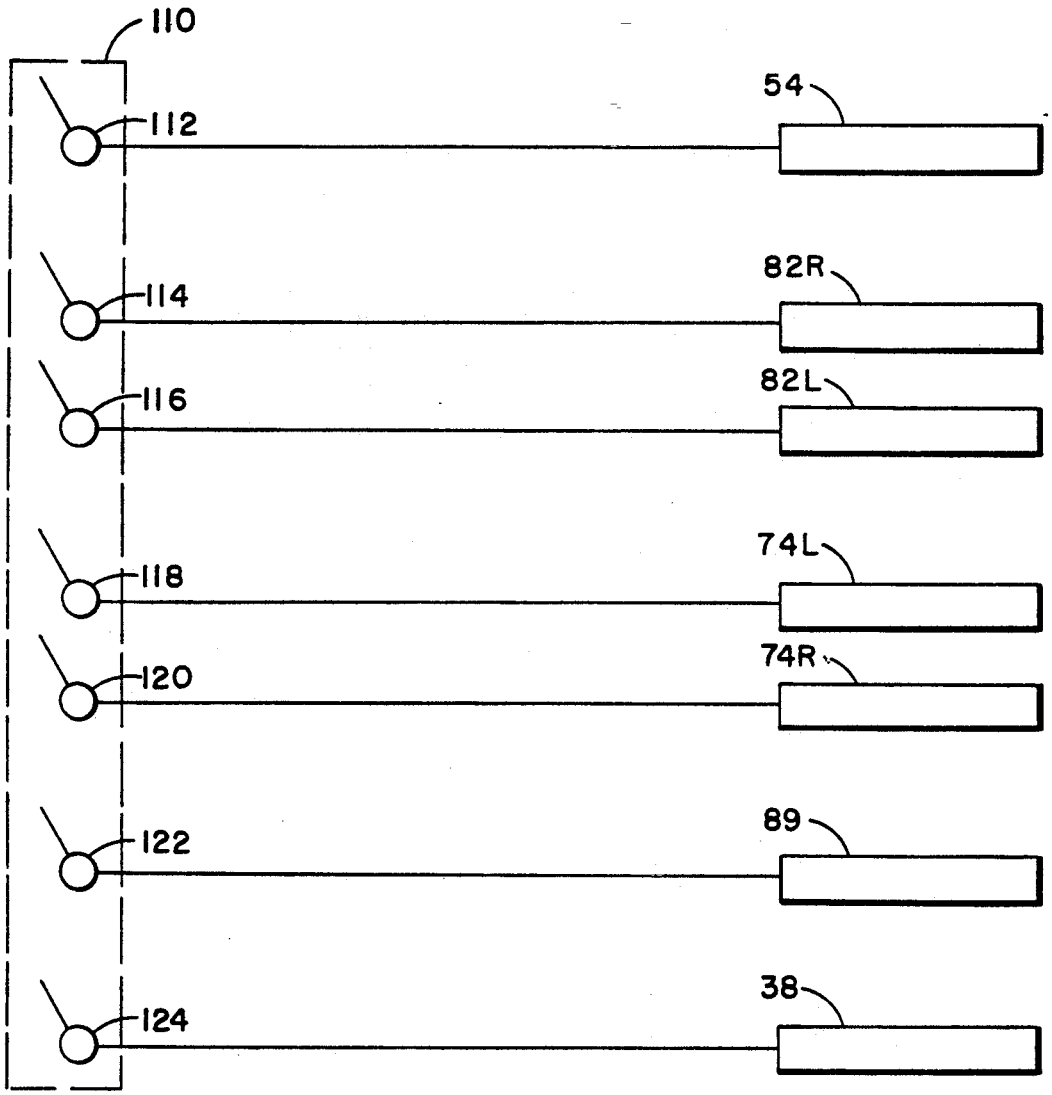
FIG. 9 is a section view of the cutter in FIG. 7 along line 8—8.

Referring to FIG. 9, there is shown a panel 110 that is preferably mounted in the cabin of a tractor that pulls trencher 10. On panel 110 are switches 112-124 which respectively control jacks 54, 82 (R and L), 74 (L and R), 89, and 38. Switches 112–124 operate by being pulled or pushed to inject hydraulic fluid into their respective jacks by conventional means. Each one of these jacks are operated individually and may be used to change angles of cutters 32 as well as the angle of attack of trencher 10. Moving switch 112 changes the position of pin 52 to vary the span between support 14 and cutters 32 (L and R).

It is recognized by the inventor that by placing pin 52 within a track 53 in bar, and using jack 54 to move pin 52 laterally, support 14 and cutter 32 on the left side and the right side of trencher 10 move inward and outward while maintaining the same distance from the axis of symmetry of trencher 10. This distance between the cutters 32 is critical to maintain the walls of the trench at identical distances from the center point of the trench when preparing a trench with walls of uniform construction. It is also recognized by the inventor that by using the various controls and hydraulics described, any angle of attack and dispersal of debris can be provided.

This concludes the description of the preferred embodiments. A reading by those skilled in the art will bring to mind various changes without departing from the spirit and scope of the invention. It is intended, however, that the invention only be limited by the following appended claims.

What is claimed is:

1. An apparatus for preparing trenches by removing earth in the ground, the apparatus comprising:

an elongated frame;

a left and a right support;

a link assembly pivotally carrying said supports with said frame;

a left and a right rotatable cutter, each cutter having an axis of rotation which is inclined with respect to horizontal and having a plurality of blades extending radially outward from said axis of rotation;

at least one motor operative to rotate said cutters about a respective axis to cut a trench out of the ground;

a left and a right cover pivotally connected to said respective left and right support at a preselected orientation and radially aligned with said blades, said cover orientation being selected to control the angle at which earth is projected over the side of the trench when the cutter rotates to prepare a trench; and means for remotely varying the orientation of said covers on said support to change the angle at which the earth is being projected.

2. The apparatus as recited in claim 1 wherein said varying means includes a jack with a piston coupled to the cover and wherein the piston expands and contracts to change the cover orientation.

3. The apparatus as recited in claim 1 further comprising:

an elongated pin connected between said cover and said support; and wherein said varying means varies the orientation of said cover by pivoting the cover on said pin.

4. An apparatus for preparing and refurbishing trenches when pulled behind a tractor, the apparatus comprising:

an elongated frame connected at its rear end to a fork pivotally engaging at least one wheel, and connected at its forward end to a trailer hitch that is operative to mate with the tractor;

a link assembly having a left and a right wing bar pivotally connected adjacent a horizontal mid portion of said frame, said bars being operative to pivot outward away from each other about a substantially vertical axis;

a left and a right support connected to said link assembly, each support carrying a cutter rotated by a motor;

a left and a right horizontal strut respectively coupled at one end to said left and right bars, and pivotally connected at its other end to a pin; and a jack having a first and a second end, said first end being connected to said frame adjacent the rear end thereof and said second end being connected to said pin adjacent the forward end of said frame, said jack having a piston which expands to move said pin forward and rearward to pivot said struts about said pin to force said wing bars, said supports and said cutters to pivot outward and inward about said vertical axis.

5. The apparatus as recited in claim 4 further comprising:

a substantially horizontal track connected to said frame and extending in a frontward to rearward direction; and a collar connected to said pin and moving within said track.

6. The apparatus as recited in claim 4 wherein said link assembly includes a left and a right bar pivotally connected at one end to said frame;

a left substantially vertical rectangular brace pivotally connected at one side to said left bar and connected on an opposite side to said left wing bar; and a right substantially vertical rectangular brace pivotally connected at one side to said right bar and pivotally connected at an opposite side to said right wing bar.

7. The apparatus as recited in claim 4 further comprising means connected between said trailer hitch and said frame for varying the angle of attack of said cutter.

8. The apparatus as recited in claim 4 further comprising a jack connecting said fork to said frame for varying the distance between the cutter and the ground.

9. The apparatus as recited in claim 4 further comprising a blade connected to a mid portion of said frame and extending below said frame.

* * * * *